US005515551A

United States Patent [19]

Yashiro

[11] Patent Number: 5,515,551

[45] Date of Patent: May 14, 1996

[54] SWIMMING GOGGLES

[75] Inventor: Tomoyuki Yashiro, Higashi-Osaka, Japan

[73] Assignee: Yamamoto Kogaku Co., Ltd., Higashi-Osaka, Japan

[21] Appl. No.: 125,794

[22] Filed: Sep. 24, 1993

[30] Foreign Application Priority Data

Sep. 24, 1992 [JP] Japan ..... 4-254865

[51] Int. Cl.[6] ..... A61F 9/02

[52] U.S. Cl. ..... 2/428; 2/445; 2/452

[58] Field of Search ..... 2/428, 430, 439, 2/440, 445, 446, 451, 452, 453; 351/156, 119, 43

[56] References Cited

U.S. PATENT DOCUMENTS 3,173,147 3/1965 Gross et al. ..... 351/156 X
4,129,362 12/1978 Lorenzo ..... 351/156 X
4,264,987 5/1981 Runckel ..... 2/428
4,986,650 1/1991 Wilhelmi ..... 351/156
5,046,199 9/1991 Hall ..... 2/452 X

FOREIGN PATENT DOCUMENTS 0694748 7/1953 United Kingdom ..... 2/452

*Primary Examiner*—Peter Nerbun
*Attorney, Agent, or Firm*—Oblon, Spivak, McClelland, Maier & Neustadt

[57] ABSTRACT

A swimming goggle includes a pair of right and left eye-cups; a coupling member for coupling the opposed inner end portions of a pair of the eye-cups; connecting members connected to the outer end portions of a pair of the eye-cups, each of which has a length such that the rear end portion reaches the vicinity of the ear when the swimming goggle is attached around the head; and an elastic band provided for joining the outer end portions of the connecting members with each other. Since the length of the connecting member is long, the elastic band is attached around a rear portion of the head and has a excellent fit. This makes it possible to eliminate an extension thereof in diving, and hence to prevent the positional shifting of the eye-cups.

14 Claims, 18 Drawing Sheets

SWIMMING GOGGLES

BACKGROUND OF THE INVENTION

1. Field of the Invention

The present invention relates to a swimming goggle.

2. Discussion of the Background

Conventionally, the goggles of this type have been described in Unexamined Japanese Utility Model Publication No. Hei 1-36505 and U.S. Pat. No. 4,264,987.

The prior art swimming goggle described above includes a pair of right and left eye-cups; a coupling member for coupling the opposed inner end portions of the eye-cups with each other, connecting members connected to the outer end portions of the eye-cups; and an elastic band for joining the outer end portions of the connecting members with each other.

In the above prior art swimming goggle, for holding the water-tightness of the eye-cups to the user's face and for preventing the positional shift of the eye-cups, the length of the elastic band has been adjusted such that the tension of the elastic band is enlarged.

As a result of this adjustment, however, when the tension of the band becomes excessively larger, the eye-cups are deeply forced toward the eyesockets and the vicinities thereof, which causes pain to the user. On the contrary, when the tension is reduced to the extent that the pain is avoided and the water-tightness can be held, there often occurs an inconvenience in that the position of the eye-cups on the user's face is shifted or the eye-cups are reversed due to the external force caused by shock in diving.

Namely, as shown in FIG. 21, when a rubber band 50 is wound around a cylindrical body 51 and both end portions of the rubber band 50 are stretched in the direction of the arrow, a portion A of the rubber band 50 in contact with the cylindrical body 51 is restricted in terms of its extension by the effect of the friction, whereas a portion B not in contact with the cylindrical body 51 is greatly extended.

The same phenomenon as described above is generated in the case where the swimming goggle is attached around the head of the user. Namely, as shown in FIG. 22, at a rear portion A of the head 52, the degree of contact between a band 53 and the head 52 is high, and the extension and contraction of the band 53 is restricted by the friction. On the contrary, at a front portion B of the head 52, the degree of contact between the band 53 and the head 52 is or, in other words, the degree of freedom for the extension and contraction is high, and the extensible portion B is excessively extended by the shock in diving, thereby causing the positional shift and reversing of the eye-cups 54.

SUMMARY OF THE INVENTION

Taking the above circumstances into consideration, the present invention has been made, and an object of the present invention is to prevent the positional shift and reverse of eye-cups.

Another object of the invention is to improve the fit of the eye-cups to the user's face.

To achieve the above object, according to the present invention, there is provided the following means:

Namely, as shown in FIG. 23, a swimming goggle 1 of the present invention includes a pair of right and left eye-cups 2; a coupling member 3 for coupling the opposed inner end portions of a pair of the eye-cups 2 with each other; connecting members 5 connected to the outer end portions of a pair of the eye-cups 2; and an elastic band 4 for joining the outer end portions of the connecting members 5 with each other. Each of the connecting members 5 located on the right and left sides has such a length that the outer end thereof reaches the vicinity of each of the right and left ears 55 when the goggle 1 is attached around a head 52.

According to the present invention having the above construction, since the outer end of each connecting member 5 reaches the vicinity of each ear 55, the degree of contact between the elastic band 4 and the head 52 is improved, thereby eliminating the extension of the elastic band 4 due to the external force in diving. Accordingly, positional shifting and reversing of the eye-cups 2 can be prevented.

Further, the provision of the long-sized connecting members makes poor the fitness of the eye-cups to the user's face; however, by forming the connecting members from a material of rubber-like elasticity, elastic deformation of the connecting members is made possible. This makes it possible to prevent the deterioration in the fitness of the eye-cups.

By turnably coupling the connecting members with the eye-cups, it is possible to further improve fitting of the eye-cups to the wearer's face.

In addition, since the most or part of the connecting members are formed from a material of rubber-like elasticity, they are intended to extend in diving; however, since the tensile strain of the material portion of rubber-like elasticity is formed so as to be smaller than that of the elastic band when the goggle is attached around the head, extension of the connecting members is prevented, and positional shifting of the eye-cups is thus provided.

The connecting member may be partially formed from a non-extensible and flexible material such as cloth or synthetic resin.

Further, in the case of forming the connecting members from a hard material such as a hard plastic, the fit can be improved by rotatably joining the connecting members with the eye-cups.

The connecting member is intended to be formed in such a manner as to be smoothly connected to the upper and lower edge portions and the front surface of the eye-cup in the vicinity of the joining portion with the eye-cup. Further, the connecting member is intended to be formed in such a manner that the vertical width and the thickness become thinner from a position near the joining portion with the eye-cup to a position near the joining portion with the elastic band. By forming the connecting member in such a streamlined shape, it is possible to reduce the flow resistance and hence to make goggle suitable for a swimming competition.

The connecting member is preferably formed of a belt adjuster rotatably mounted on the eye-cup; a tail lock mounted on the end of the elastic band; and a belt clip for connecting the belt adjuster to the tail lock. The belt clip is preferably formed from a material of rubber-like elasticity. Further, the adjuster and the tail lock are, preferably, formed from a hard plastic. By forming the joining member for joining the connecting member with the eye-cup from a hard plastic, it is possible to prevent the abrasion.

Further, by integrally molding the belt adjuster, the belt clip and the tail lock with each other, it is possible to enhance the integral feeling, to reduce the flow resistance and improve the design characteristic, and to enhance the effect in design.

In addition, since the tapered surface of the clip of the coupling member for coupling the opposed inner end portions of the eye-cups with each other is fitted on the tapered surface formed on a nose belt mounting portion of the eye-cup so that lateral and vertical movement is restricted, it is possible to further improve the fitness.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein:

FIG. 13(*b*) is a sectional view taken along the line D—D of FIG. 13(*a*); FIG. 13(*c*) is a rear view.

FIG. 14(*b*) is a rear view; FIG. 14(*c*) is a left side view of FIG. 14(*a*); FIG. 14(*d*) is a right side view of FIG. 14(*a*); FIG. 14(*e*) is a left side view of FIG. 14(*d*); and FIG. 14(*f*) is a sectional view taken along the line F—F of FIG. 14(*c*);

FIG. 17(*b*) is a rear view; FIG. 17(*c*) is a sectional view taken a long the line I of FIG. (*a*); FIG. (*d*) is a sectional view taken along the line H—H of FIG. 17(*a*); and FIG. (*e*) is a sectional view taken along the line K—K of FIG. 17(*b*);

FIG. 18(*b*) is a rear view; FIG. 18(*c*) is a view taken along the arrow L of FIG. (*a*); FIG. (*d*is a left side view of FIG. 18(*c*); FIG. 18(*e*) is a right side view of FIG. 18(*c*); FIG. (*f*) is a sectional view taken along the line M—M of FIG. 18(*b*); and FIG. 18(*g*) is a sectional view taken along the line N—N of FIG. 18(*a*);

DESCRIPTION OF THE PREFERRED EMBODIMENTS

Hereinafter, embodiments of the present invention will be described with reference to the accompanying drawings.

Figure 1:
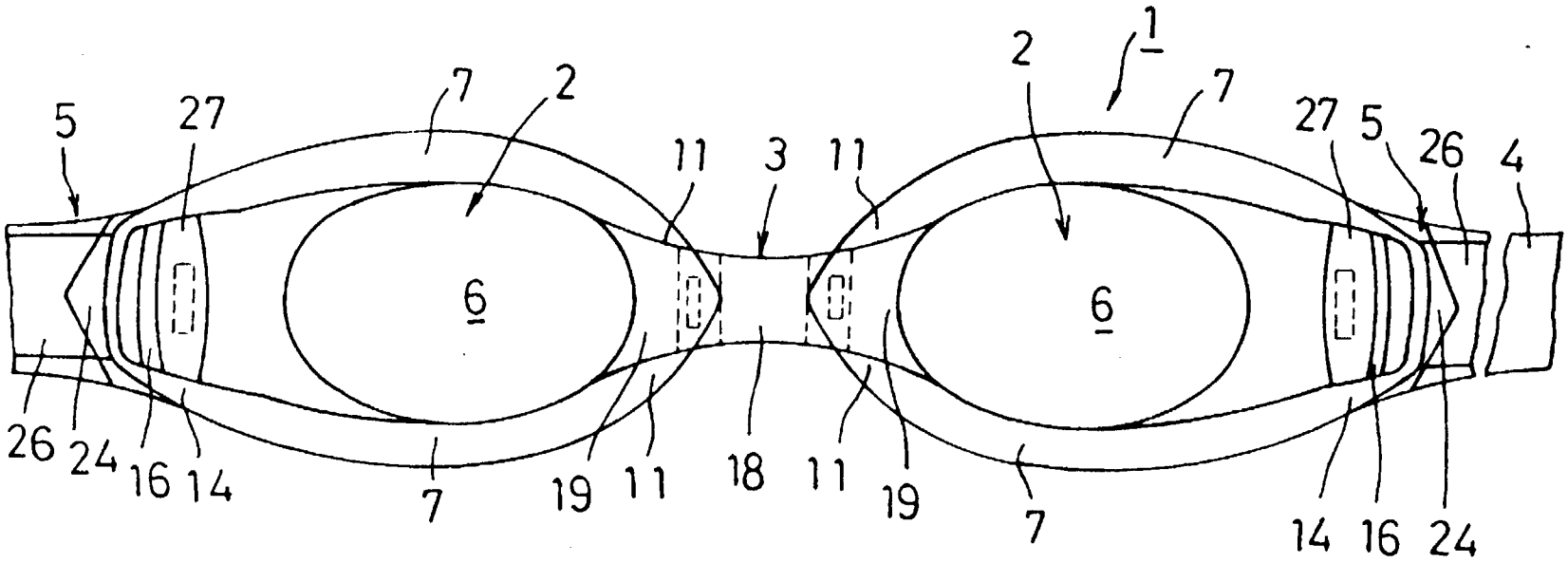
FIG. 1 is a front view showing an embodiment of the present invention.
Figure 2:
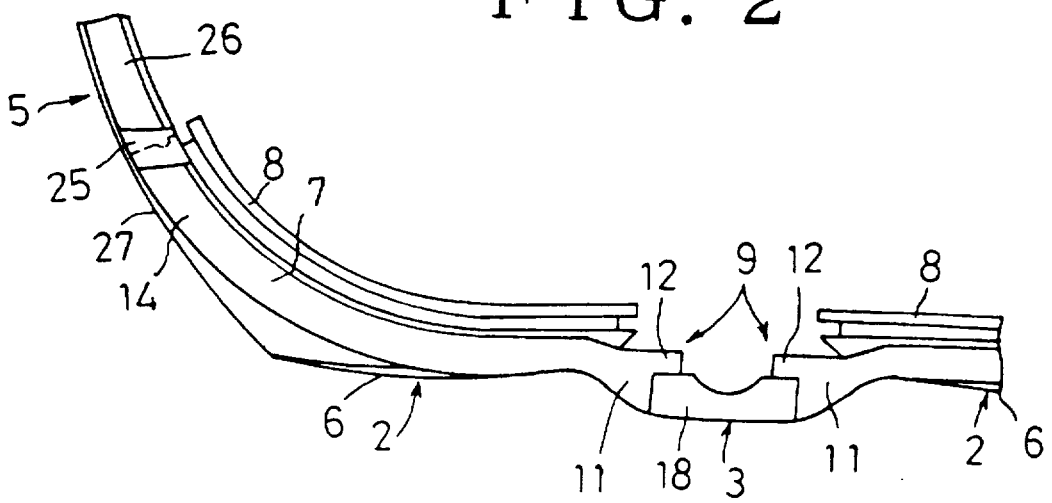
FIG. 2 is a schematic plan view of FIG. 1, with parts partially omitted.
Figure 3:
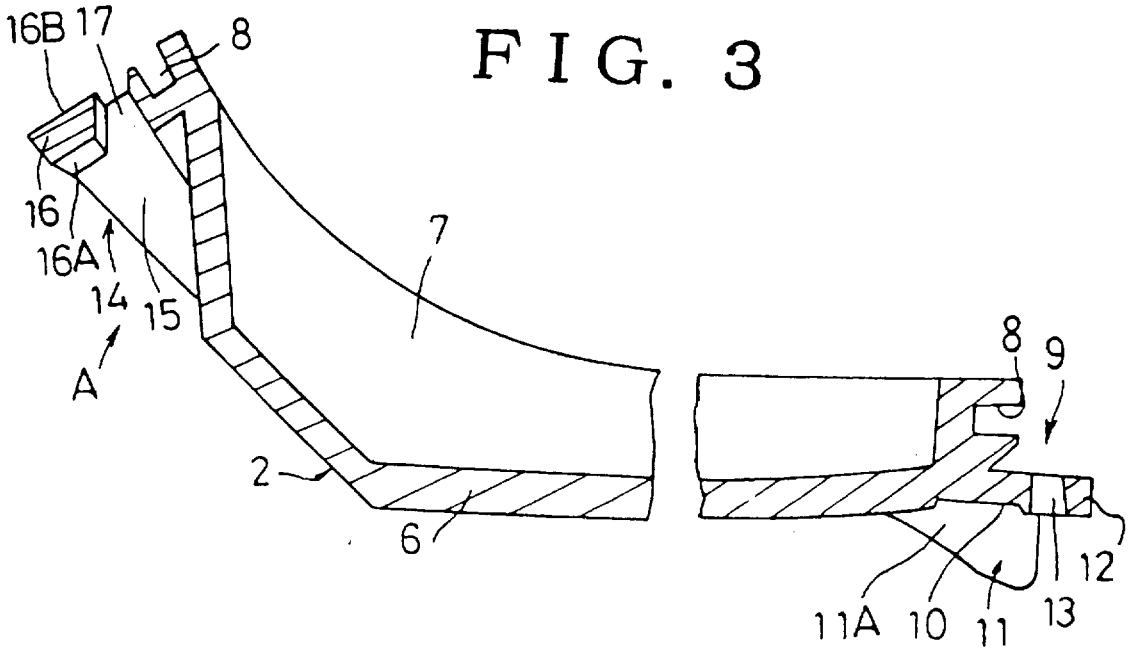
FIG. 3 is an enlarged view of the central section of an eye-cup in the same embodiment.
Figure 4:
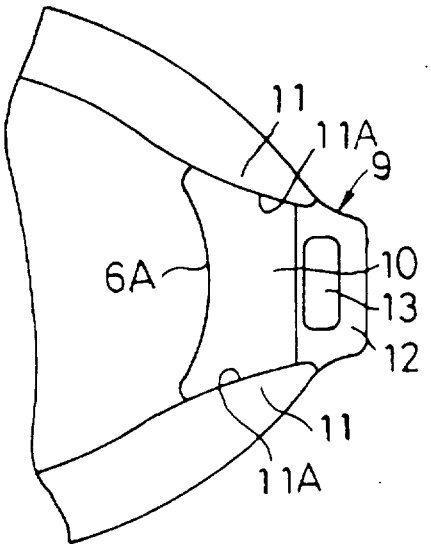
FIG. 4 is a front view of a coupling member mounting portion of the eye-cup.
Figure 5:
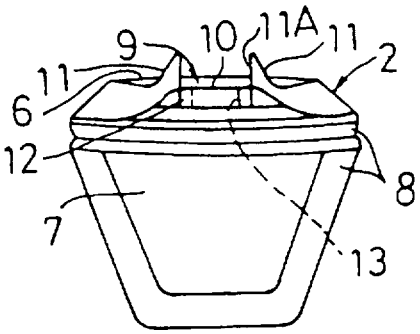
FIG. 5 is a right side view of FIG. 4.
Figure 6:
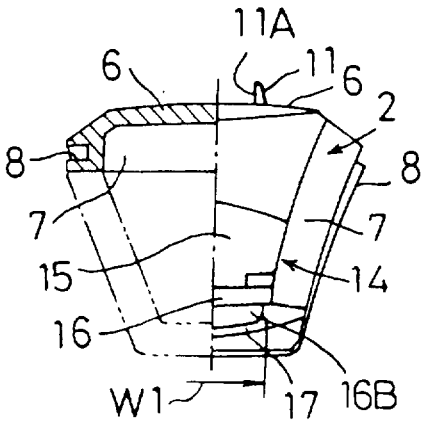
FIG. 6 is a rear view of FIG. 5, with parts partially broken.
Figure 7:
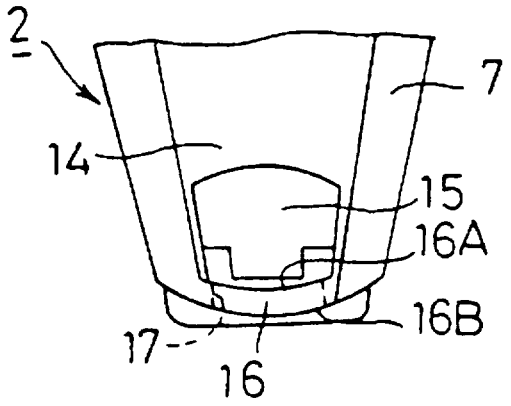
FIG. 7 is a view taken along the arrow A of FIG. 3.

As shown in FIGS. 1 and 2, a goggle 1 of the present invention includes a pair of right and left eye-cups 2 and 2, a coupling member 3 for coupling the opposed inner end portions of the eye-cups 2 and 2 with each other, an elastic band 4, and a connecting member 5 for connecting each eye-cup 2 and the elastic band 4 to each other.

As shown in FIGS. 3 to 7, the eye-cup 2 is integrally molded from a transparent or semi-transparent synthetic resin such as polycarbonate, and which includes a flat lens portion 6 on the front surface and a peripheral wall portion 7 projecting rearward from the peripheral edge of the lens portion 6. A pad mounting portion 8 for mounting an annular pad (not shown) having a flexible elasticity is formed at the rear end of the peripheral wall portion 7. A mounting portion 9 for mounting a coupling member 3 is projectingly provided on the laterally opposed inner side of the peripheral wall portion 7. A belt connecting portion 14 is provided on the outer end of the peripheral wall portion 7.

The front surface of the mounting portion 9 of the eye-cup 2 is formed in an approximately rectangular flat surface 10. Upper and lower walls 11 and 11, which project forward, are formed at the upper and lower end portions of the flat surface 10, respectively. A coupling piece 12 is projectingly provided on the opposed inner end side of the upper and lower walls 11 and 11. An approximately square locking hole 13 is provided on the coupling piece 12 so as to pass through the upper and lower surfaces thereof. The opposed upper and lower surfaces of the upper and lower walls 11 and 11 are each formed in tapered surfaces 11A and 11A which are narrower on the coupling piece 12 side. On the other hand, the outer side upper and lower surfaces are each formed with curved surfaces, which are intended to reduce the flow resistance and to improve the appearance.

Figure 10:
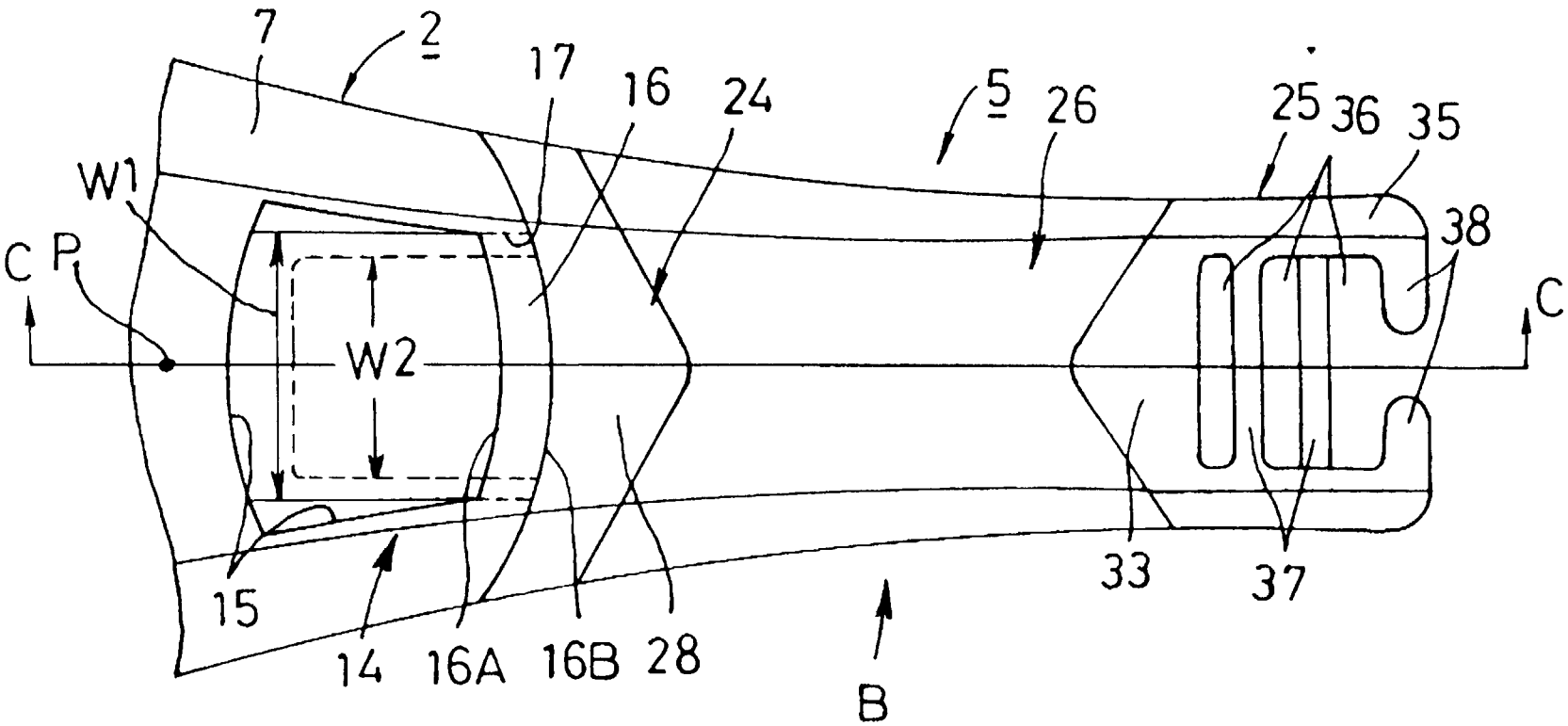
FIG. 10 is an enlarged front view of the connecting member in the same embodiment.
Figure 11:
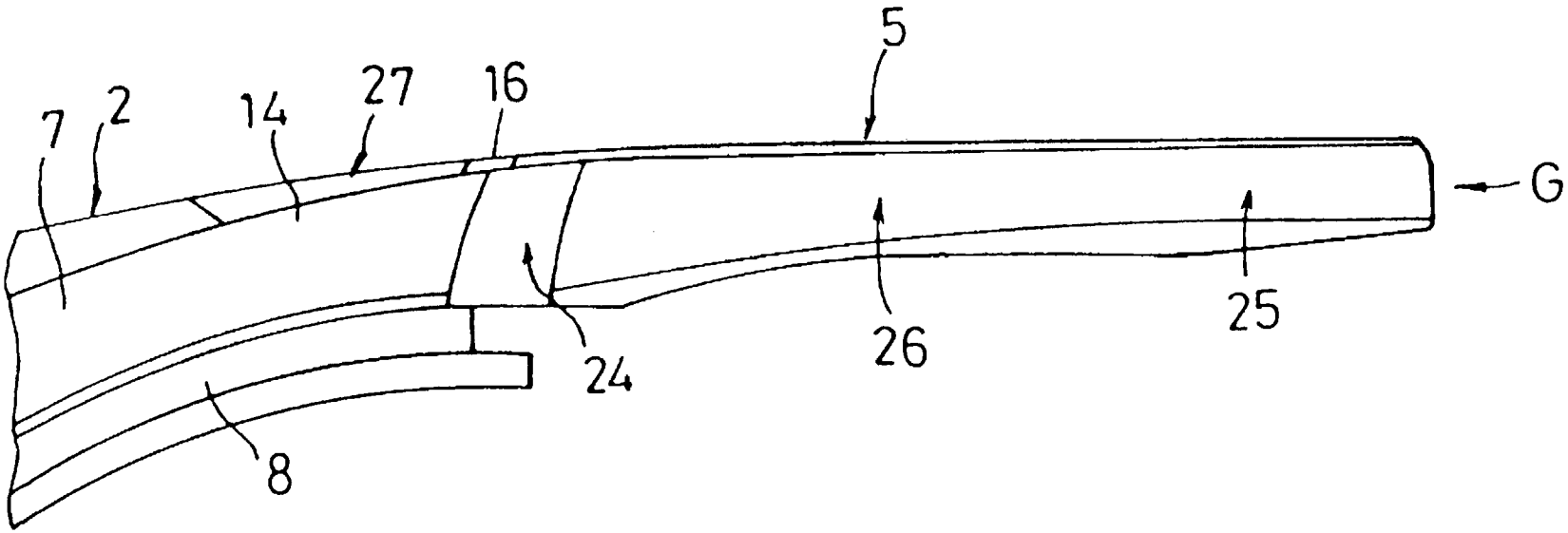
FIG. 11 is a view taken along the arrow B of FIG. 10.

The laterally outer end side (opposed to the above mounting portion 9) of each peripheral wall portion 7 of the eye-cup 2 extends in such a manner as to be inclined rearward, and the end portion thereof forms the above belt connecting portion 14. A recessed portion 15 hollowed from the front side is formed on the connecting portion 14. In a rear wall 16 of the recessed portion 15, inner and outer wall surfaces 16A and 16B are formed in surfaces with circular-arcs around a point P as shown in FIG. 10. Further, the rear wall 16 is formed with a belt adjuster engaging hole 17 with a rectangular shape long in the vertical direction in such a manner as to pass through the rear wall 16 (see FIGS. 3, 6, and 7).

The outer wall surface 16B of the rear wall and the engaging hole 17 serve as the guide surfaces for guiding the turning of a belt adjuster described later.

The coupling member 3 includes a nose belt 18 and a clip 19. The nose belt 18 is formed from a synthetic resin such as nylon elastomer, and which is formed with a recessed portion 18A on the rear side (face side) and has a curved surface on the rear surface central portion. Engaging projecting pieces 20 and 20 are provided near the rear ends of the lateral side surfaces of the nose belt 18. A rectangular clip locking hole 21 is provided on the engaging projection piece 20 in such a manner as to pass therethrough back and forth. A clip fitting recessed portion 18B hollowed toward the center is formed on each of the front lateral side surfaces of the nose belt 18.

The clip 19 is formed from an elastic material such as synthetic resin. As shown in FIG. 14(*a*) to FIG. 14(*e*), the clip 19 includes a fitting portion 22 formed in the shape approximately similar to a piece of Japanese chess in the front view, and two locking leg portions 23 projectingly provided on the back surface of the fitting portion 22. Each of the upper and lower surfaces of the fitting portion 22 serves as a tapered surface 22A to be fitted to the taper surface 11A of the eye-cup 2. The nose side end portion held between the tapered surfaces 22A is formed in a projecting portion 22B. The projecting portion 22B is fitted to the fitting recessed portion 18B of the nose belt 18. Further the end portion opposed to the projecting portion 22B held between the tapered surfaces 22A is formed in a recessed portion 22C. The recessed portion 22C is formed in a circular-arc surface corresponding to an opposed inner side circular-arc 6A on the front surface of the lens portion 6 of the eye-cup 2 (see FIG. 4).

Figure 8:
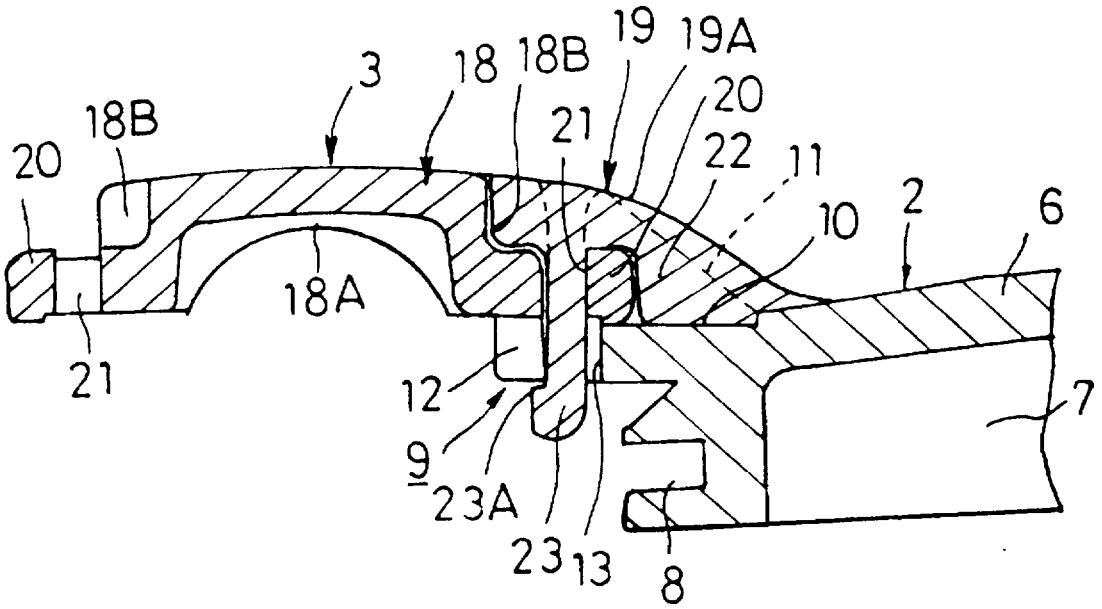
FIG. 8 is an enlarged view of a transverse section showing the coupling state between the eye-cup and the coupling member in the same embodiment.
Figure 9:
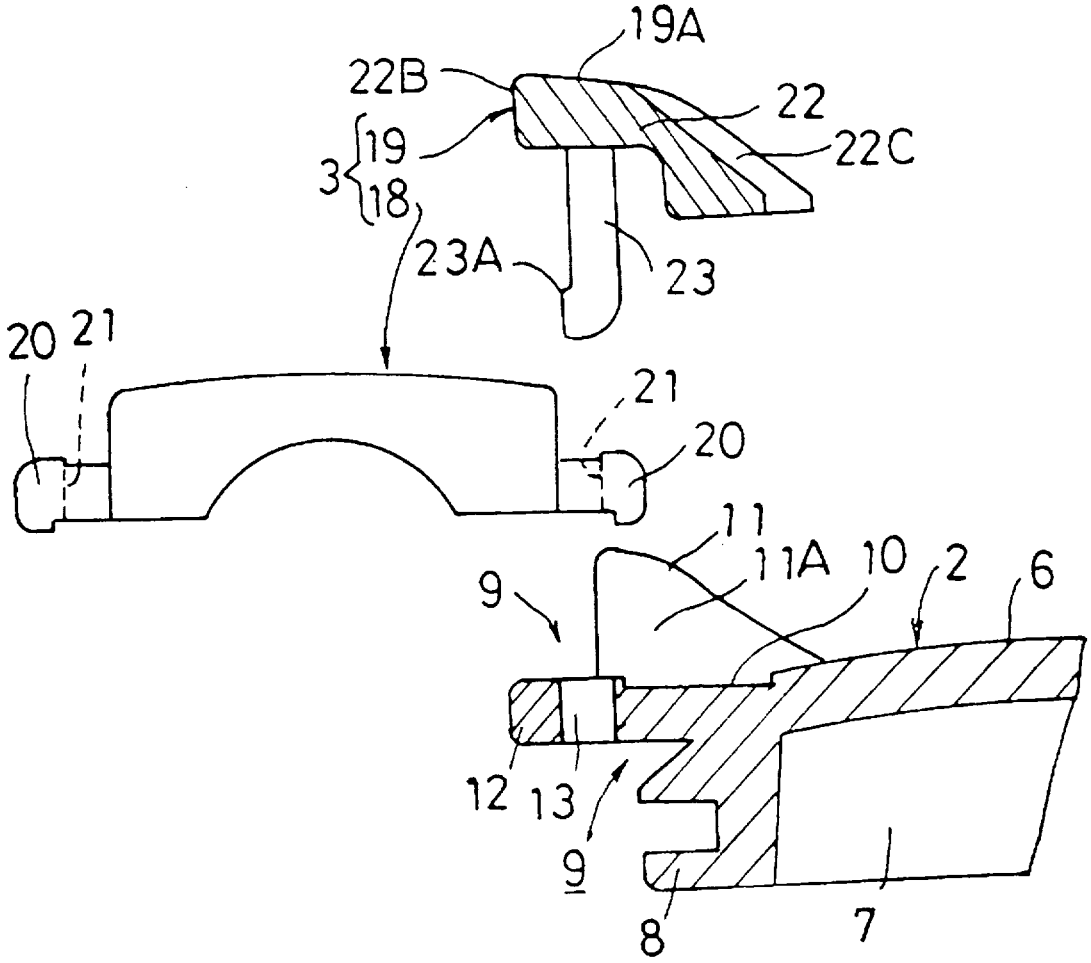
FIG. 9 is an exploded view of FIG. 8.

As shown in FIGS. 8 and 9, a front surface 19A of the clip 19 is formed in a smooth curved surface which corresponds to the surface level to the front surface of the nose belt 18 and the outer surface of each of the upper and lower wall 11 of the eye-cup 2. Further, a locking claw 23A is formed on the end portion of the locking leg portion 23 of the clip 19. Thus, the leg portion 23 passes through the clip locking hole 21 of the nose belt 18 and the locking hole 13 of the eye-cup 2, and the locking claw 23A is caught by the periphery portion of the locking hole 13 of the coupling piece 12, to thereby prevent the slipping off of the clip 19.

Since the nose belt 18 is laterally stretched when the goggle 1 is attached around the head, the clip 19 is stretched oppositely inwardly through the locking leg portion 23, and the tapered surface 22A of the clip 19 is fitted to the tapered surface 11A of the mounting portion of the eye-cup 2, so that the clip 19 is forcibly fixed on the mounting portion 9 of the eye-cup 2. Thus, the eye-cup 2 is restricted in its lateral and vertical movements and is prevented from being shaken. This makes it possible to stabilize the coupling state of the eye-cups 2 and 2, and hence to stably fit the eye-cups 2 and 2 on the user's face.

In addition, at least three kinds of the nose belts 18, having large, medium and small lengths, are prepared so as to correspond to the shape and size of the user's face. Accordingly, the user is able to select the nose belt having such a length as to be fitted to his face.

The elastic band 4 comprises a rubber belt, which has been commonly adopted.

Figure 23:
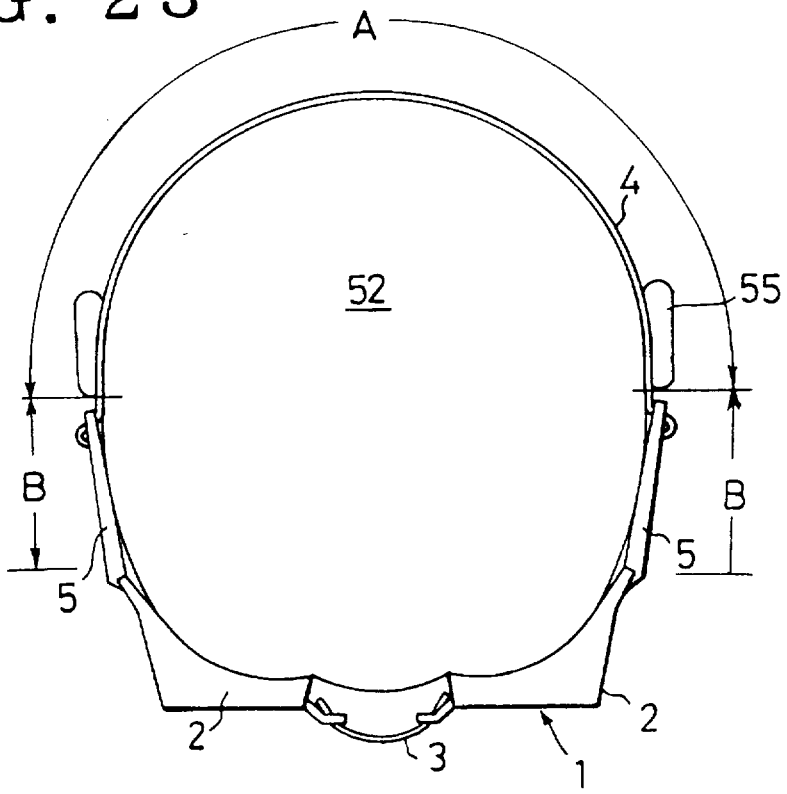
FIG. 23 is a plan view of a goggle of the present invention which is attached around the head.

As shown in FIG. 23, the connecting member 5 has such a length that the rear end portion reaches the vicinity of the ear 55. The length extending from the outer end on the surface of the lens portion 6 of the eye-cup 2 to the rear end portion of the connecting member 5 is specified in the range of from about 70 mm to 100 mm.

As shown in FIGS. 10, 11, 12 and 15, the connecting member 5 includes a hard plastic made belt adjuster 24, a tail lock 25, and a belt clip 26 of a high elastic (soft) plastic being a material of rubber-like elasticity. The connecting member 5 comprises an integrally molded product, which integrally joins the belt adjuster 24, the tail lock 25 and the belt clip 26 with each other. Further, the connecting member 5 is mounted on the mounting portion 14 of the eye-cup 2 through the belt stopper 27 in such a manner as to be relatively turnable in the vertical direction.

As shown in FIG. 17(*a*) to FIG. 17(*e*), the belt adjuster 24 includes a main body portion 28 in which the upper and lower surfaces are respectively similar in the surface level to the upper and lower surfaces at the end portion of the belt connecting portion 14 of the eye-cup 2, and which has a circular-arc turning guide surface 28A; an engaging portion 29 formed in an approximately square shape in the front view which projects from the guide surface 28A; and a belt clip joining portion 30. The joining portion 30 is joined to the main body portion 28 through two joining bar-like portions 31, and which is vertically provided with a circular-arc engaging hole 32.

Figure 15:
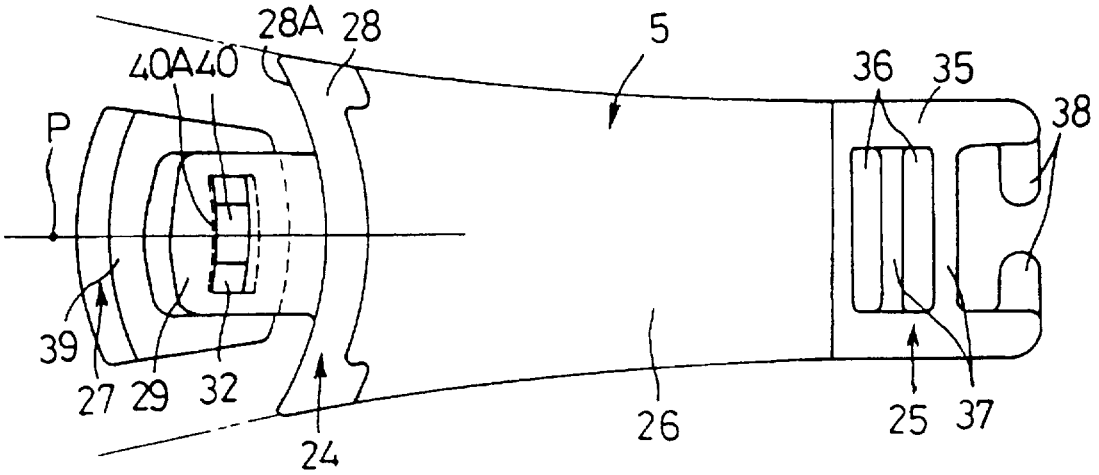
FIG. 15 is a rear view of the connecting member in the same embodiment.
Figure 16:
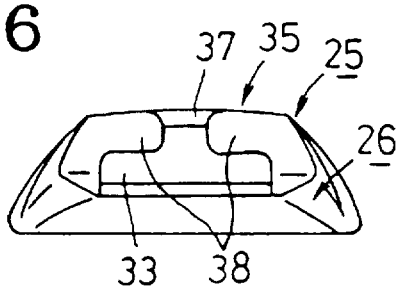
FIG. 16 is a view taken along the arrow G of FIG. 11.
Figure 19:
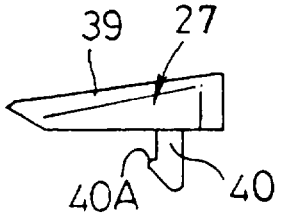
FIG. 19 is a plan view showing a belt stopper in the same embodiment.
Figure 17A:
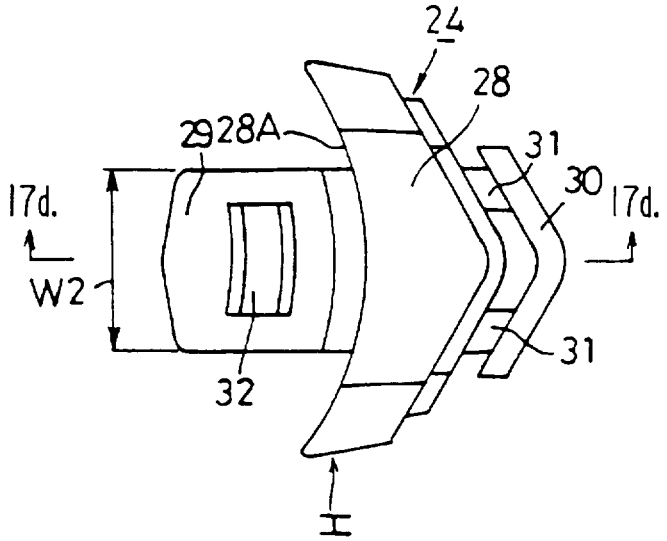
FIG. 17(*a*)–17*e* show a belt adjuster in the same embodiment; wherein FIG. 17(*a*) is a front view.
Figure 17E:
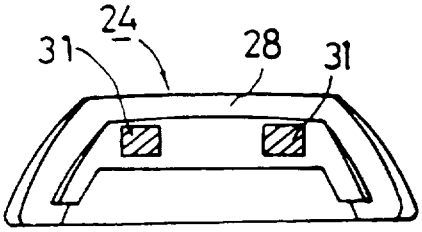
Figure 17B:
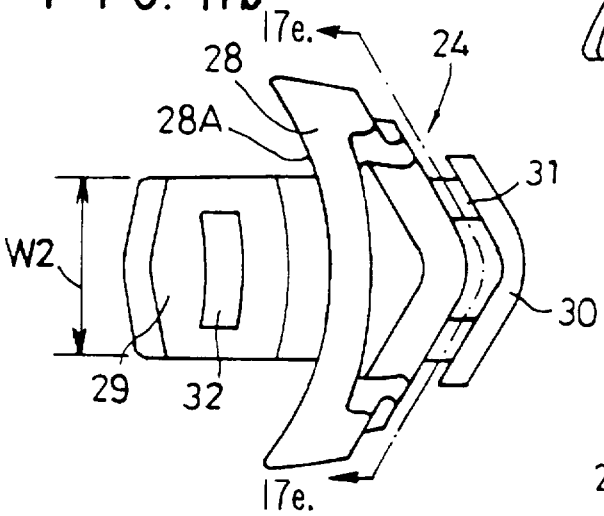
Figure 17D:
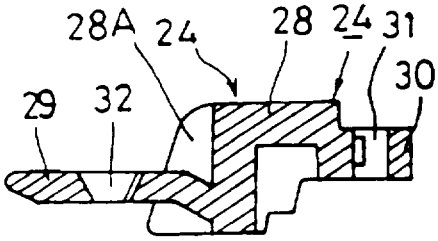
Figure 17C:
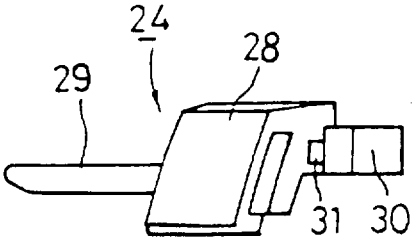
Figure 18A:
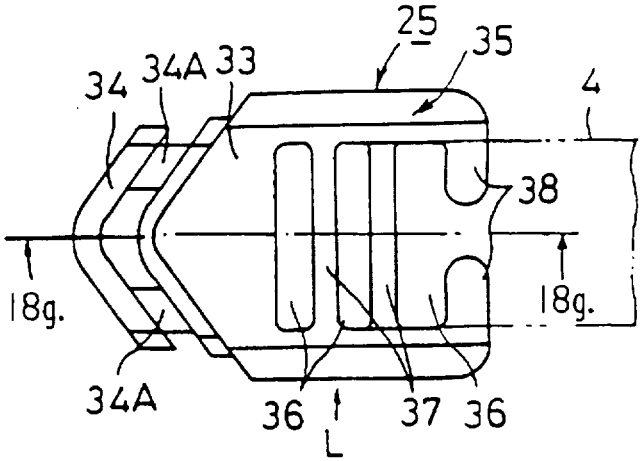
FIGS. 18(*a*)–(*g*) show a tail lock in the same embodiment, wherein FIG. 18(*a*) is a front view.
Figure 18D:
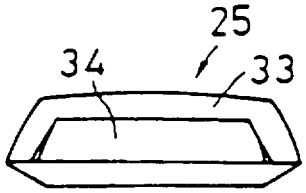
Figure 18E:
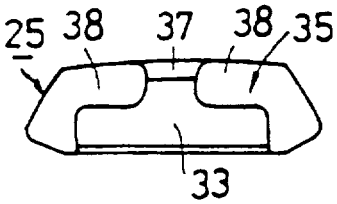
Figure 18B:
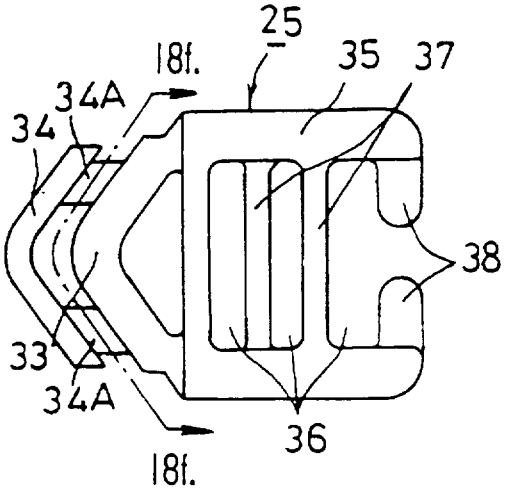
Figure 18F:
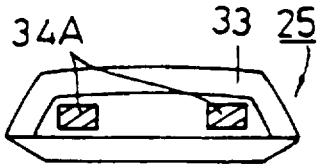
Figure 18G:
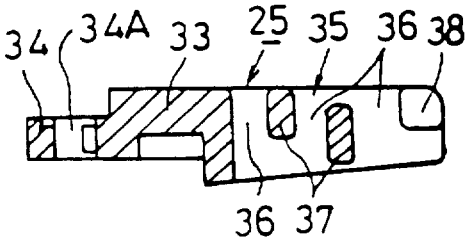
Figure 18C:
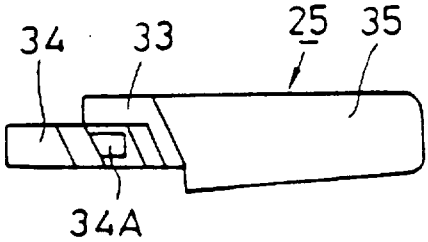

The engaging hole 32, as shown in FIGS. 10 and 15, includes a surface with a circular-arc around a circular-arc curvature center P. Further, the guide surface 28A of the main body portion 28 is formed in a surface with a circular-arc around the center P. Thus, the belt adjuster 24 is turnable relatively to the eye-cup 2 around the center P. In addition, the engaging portion 29 is so constructed that the vertical width W2 is fairly narrowed as compared with the vertical width W1 of the engaging hole 17 of the eye-cup 17 (see FIG. 10), so that it can slidably pass through the engaging hole 17 slidably in the vertical direction.

In addition, as shown in FIG. 17(*e*), the engaging hole 32 is broadened in width on the front side, so that the belt stopper 27 is easily inserted and fitted in the engaging hole 32.

The tail lock 25, as shown in FIG. 18(*a*) to FIG. 18(*g*), includes a main body portion 33, a joining portion 34 on the front side, and a belt mounting portion 35 on the rear side. The joining portion 34 is joined to the main body portion 33 through a bar-like portion 34A. The belt mounting portion 35 is formed with belt inserting holes 36 long in the vertical direction, and belt hooking portions 37, and which is further provided at the rear end with a belt pressing portion 38 with the center portion being cut.

In molding the belt clip 26, the belt clip 26 is inserted with the entirety of the joining portion 30 of the belt adjuster 24 and the joining bar-like portion 31, and a part of the main body portion 28; and the whole of the joining portion 34 of the tail lock 25 and the joining bar-like portion 34A, and with a part of the main body portion 33, to integrally join these parts with each other. The vertical surfaces and the back and forth surfaces of the belt adjuster 24, the tail lock 25 and the belt clip 26 have a similar surface level to reduce the flow resistance, to improve the integral feeling to the eye-cup 2, and to enhance the design characteristic.

The tensile strain of the belt clip 26 is intended to be smaller than that of the elastic band 4 when the goggle 1 is attached to the head. For reducing the tensile strain of the belt clip 26 than that of the elastic band 4, the belt clip 26 may be formed from a material having an elastic modulus larger than that of the elastic band 4, or may be enlarged in its sectional area more than that of the elastic band 4 if it is formed from a material having the same elastic modulus as that of the elastic band 4.

Figure 20:
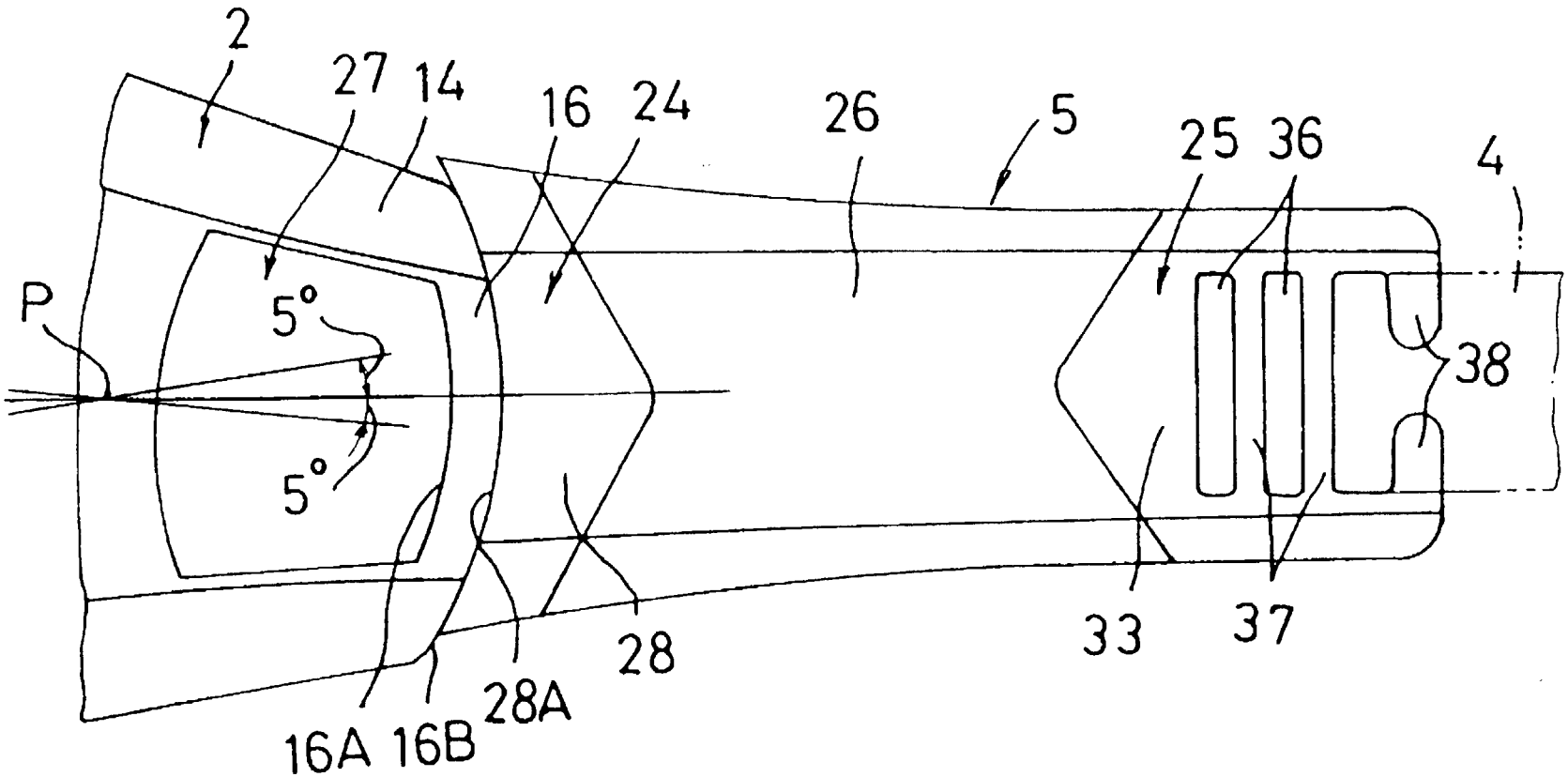
FIG. 20 is a view for explaining the turning state of the eye-cup and the connecting member in the same embodiment.
Figure 21:
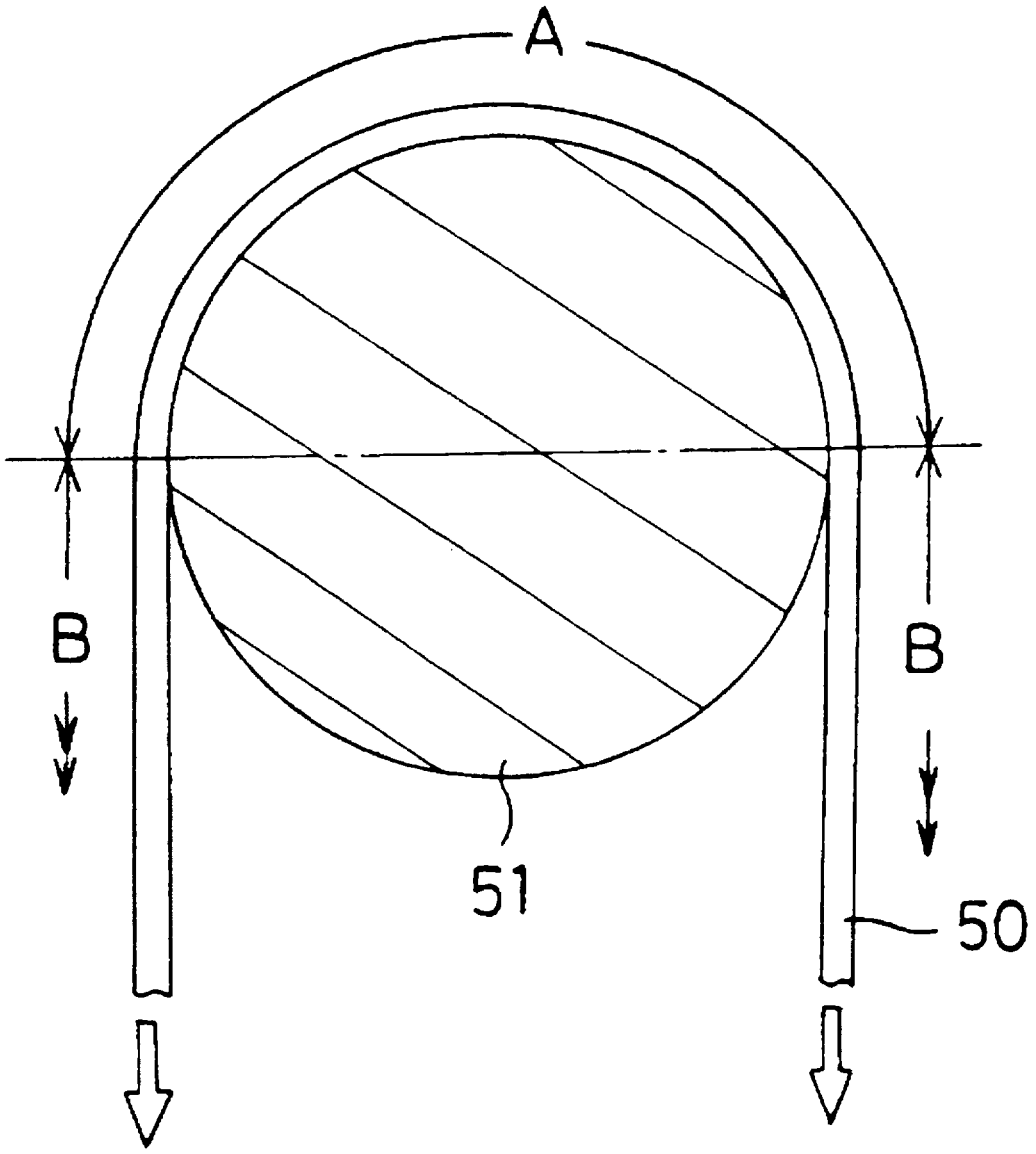
FIG. 21 is a sectional view for explaining the extension of the elastic band.
Figure 22:
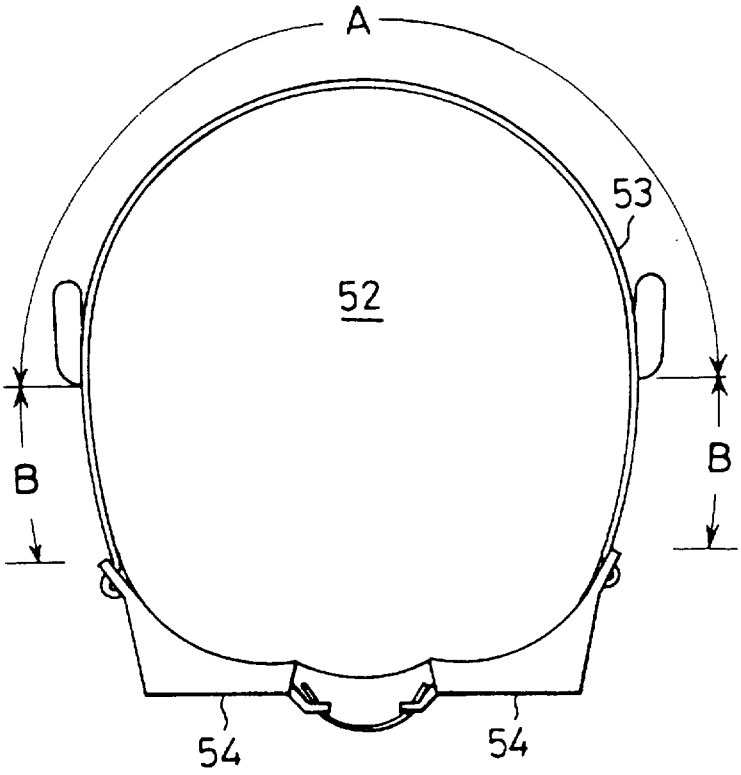
FIG. 22 is a plan view a prior art goggle which is attached around the head.

The belt stopper 27, as shown in FIGS. 10, 12, 15 and 19, includes a lid-like fitting portion 39 fitted to the recessed portion 15 provided on the mounting portion 14 of the eye-cup 2, and a locking shaft portion 40 formed in a circular-arc band shape with section which is projectingly provided on the back surface. The front surface of the fitting portion 39 is formed with smooth circular-arc surface so as to be similar in the surface level to the front surface of the mounting portion 14. The locking shaft portion 40 is freely fitted in the engaging hole 32 of the adjuster 24. Since the vertical width of the shaft 40 is narrower than that of the engaging hole 32, the connecting member 5 is intended to be vertically rotatable around the center P with respect to the eye-cup 2 by each about member 5 (see FIG. 20).

A claw 40A is projectingly provided on the rear end portion of the locking shaft portion 40 so as to be caught by the periphery portion of the engaging hole 32 on the rear surface of the engaging portion 29 of the belt adjuster 24, to be thus prevented from being easily slipped-off. In addition, the connecting member 5 is restricted in back and forth movement by the locking shaft portion 40 freely fitted in the engaging hole 32 of the adjuster 24, and is relatively rotatable while being guided by the locking shaft portion 40, the outer wall surface 16B of the mounting portion of the eye-cup 2, and the engaging hole 17.

In this embodiment, as shown in FIG. 8, in the case that the eye-cups 2, 2 are coupled to each other by the coupling member 3, either of the large, medium and small sized nose belts 18 is selected corresponding to the shape and size of the user's face. Subsequently, the engaging projecting pieces 20 at both ends of the nose belt 18 are abutted on the front surfaces of the coupling pieces 12 of the mounting portions 9 of the eye-cups 2 and 2, so that both the engaging holes 13, 13 and 21, 21 are made to correspond with each other. After that, the clips 19 are fitted between the upper and lower walls 11 and 11 of the eye-cups 2 and 2 such that the locking leg portions 23 and 23 are inserted in the holes 13, 13 and 21, 21, thus making it possible to simply and assuredly couple the coupling member 3 with the eye-cups 2 and 2.

Figure 12:
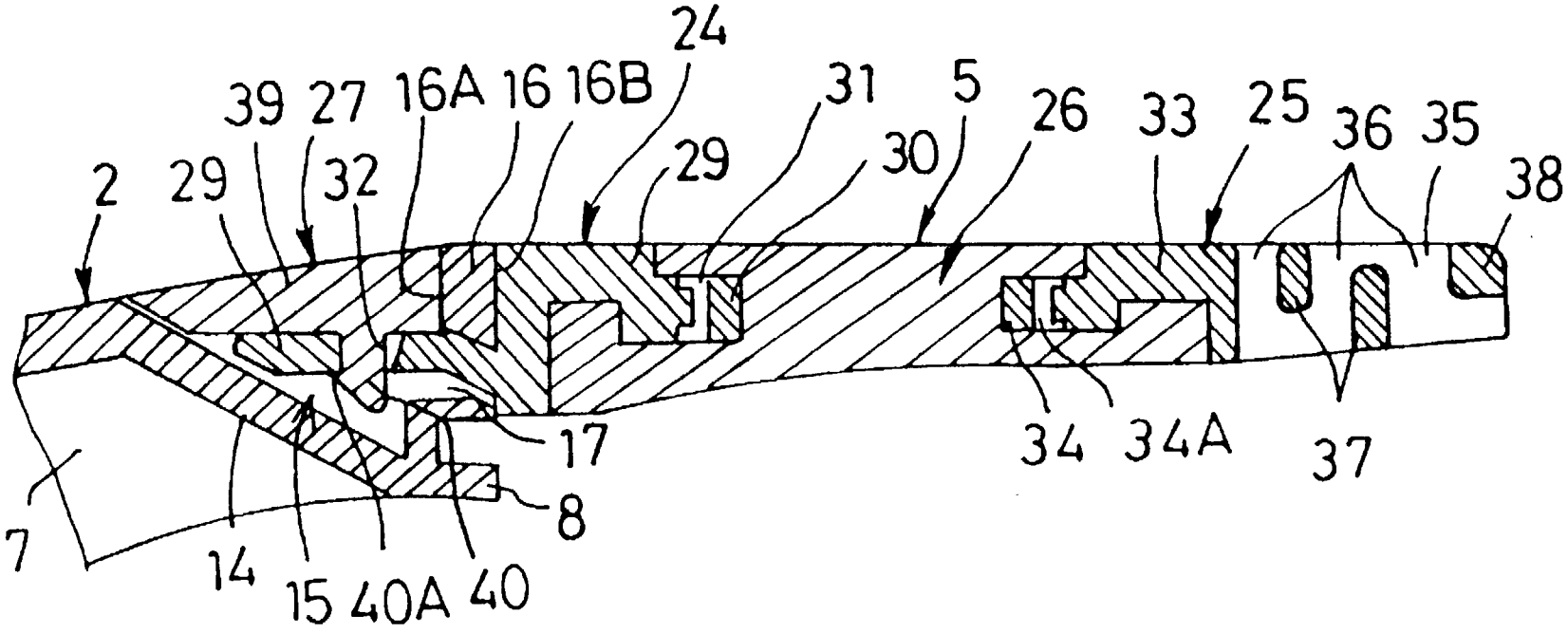
FIG. 12 is a sectional view taken along the line C—C of FIG. 10.
Figure 13A:
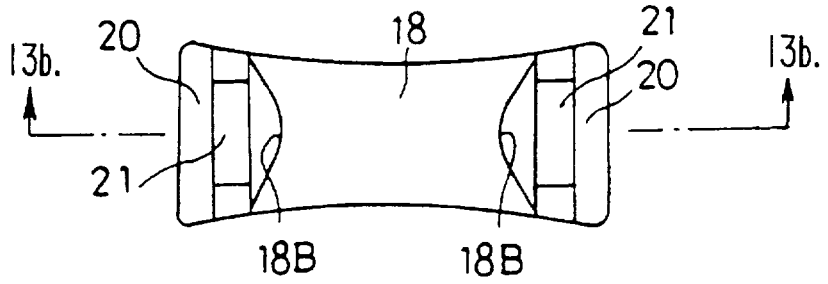
FIG. 13(*a*)–(*d*) shows a nose belt in the same embodiment, wherein FIG. 13(*a*) is a front view.
FIG. 13*d* is a sectional view taken along the line E—E of FIG. 13(*c*)
Figure 13B:
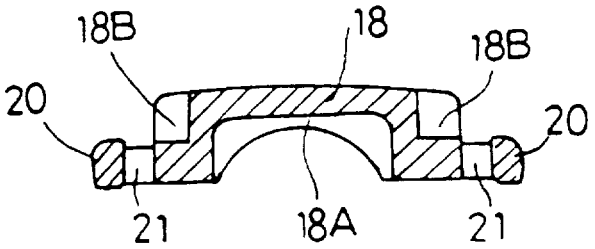
Figure 13C:
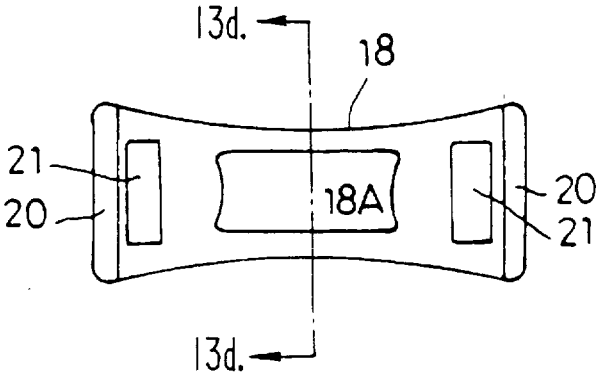
Figure 13D:
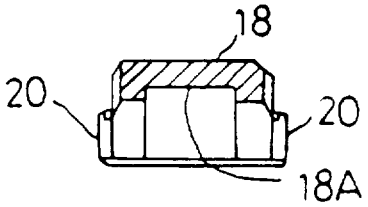
Figure 14A:
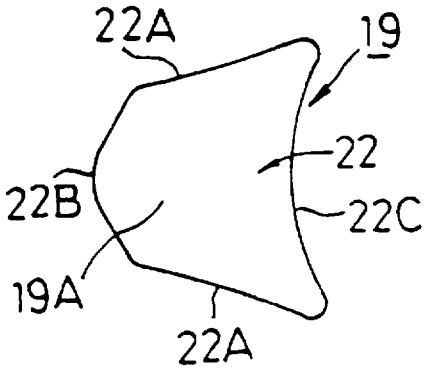
FIG. 14(*a*)–14(*e*) show a clip of the nose belt in the same embodiment; wherein FIGS. 14(*a*) is a front view.
Figure 14B:
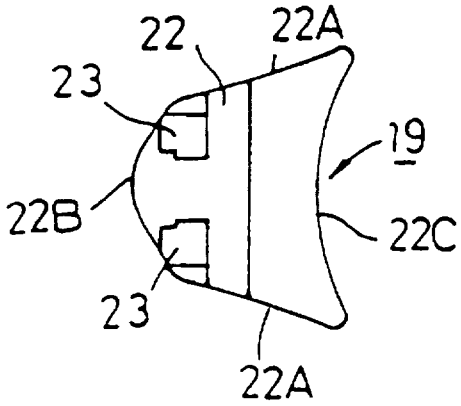
Figure 14F:
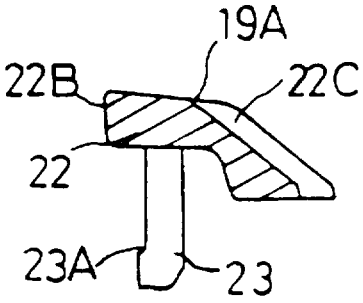
Figure 14C:
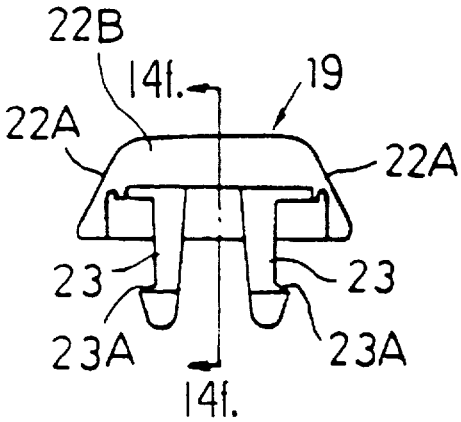
Figure 14E:
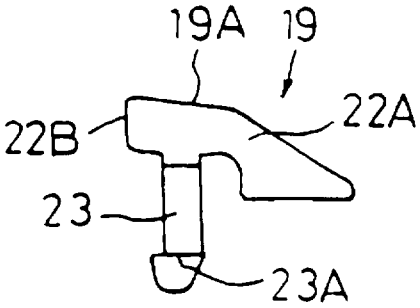
Figure 14D:
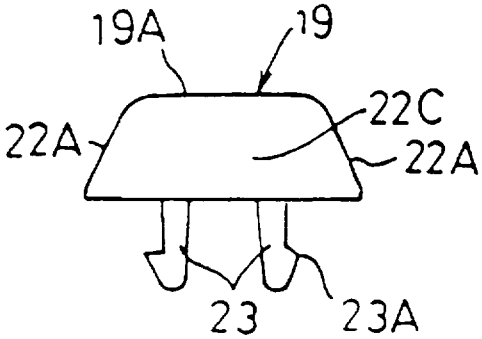

Further, as shown in FIG. 12, in the case where the connecting member 5 is connected to the eye-cup 2, the engaging portion 29 of the belt adjuster 24 is inserted in the engaging hole 17 of the belt connecting portion 14 of the eye-cup 2, and the guide surface 28A of the adjuster 24 is abutted on the outer wall surface 16B, after which the belt stopper 27 is fitted in the recessed portion 15 of the belt connecting portion 14 such that the locking shaft portion 40 is fitted in the engaging hole 32 of the adjuster 24, thus making it possible to simply and assuredly connect the connecting member 5 to the eye-cup 2.

In addition, the mounting of the elastic band 4 to the tail lock 25, and the length adjustment for the elastic band 4 are performed in the same manner as conventional.

Figure 24:
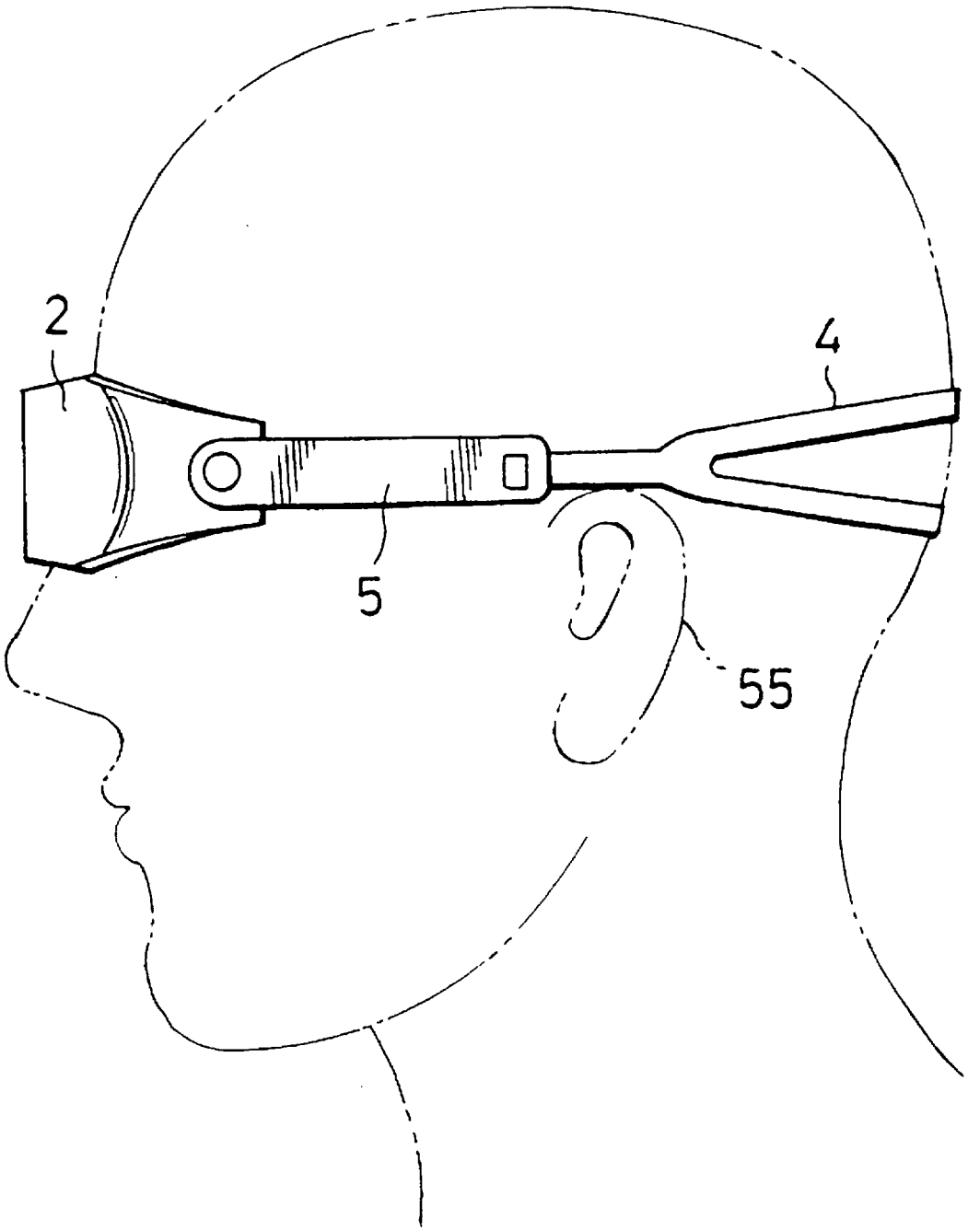
FIG. 24 is a side view showing an embodiment of the present invention wherein connecting members are formed from a hard material.

The connecting member 5 as shown in FIG. 24 is formed from a hard material. In such a case, the rear end portion of the connecting member 5 is positioned in the vicinity of the ear 55. For improving the fitness of the eye-cups 2 to the user's face, each connecting member 5 is connected to the eye-cup 2 so as to be pivotable.

The most or part of the connecting member 5 in the length direction may be formed from a non-extensible and flexible material such as synthetic resin.

Figure 25:
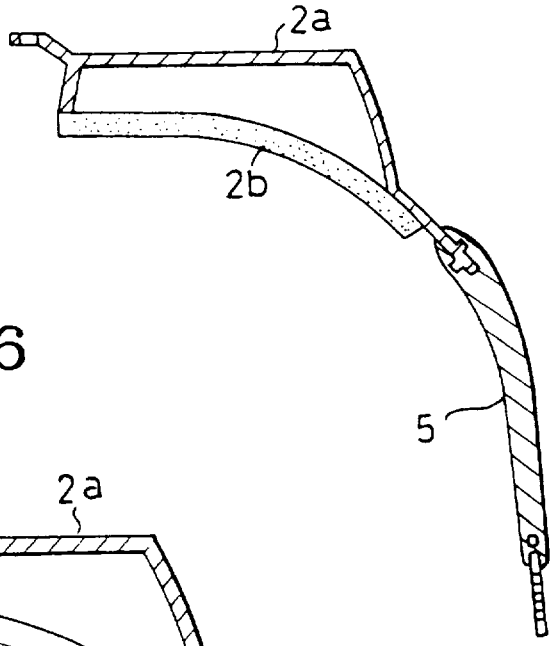
FIG. 25 is a sectional view showing an embodiment of the present invention wherein an eye-cup main body and a connecting member are molded integrally with each other.
Figure 26:
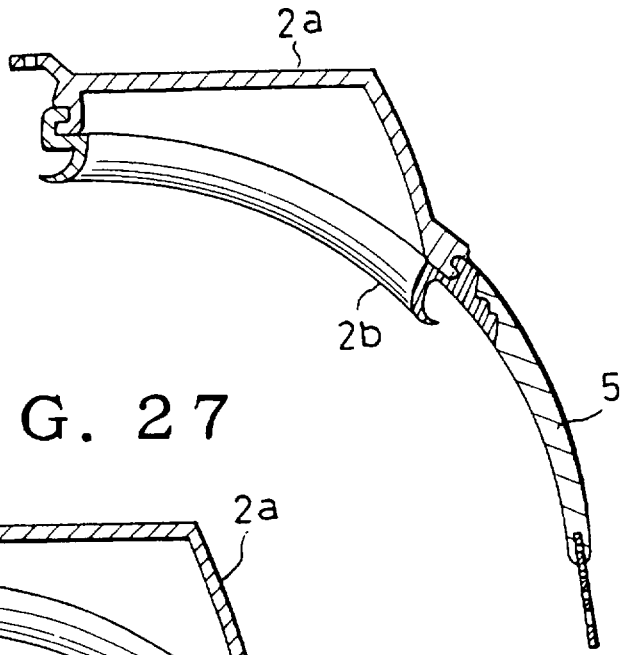
FIG. 26 is a sectional view showing an embodiment of the present invention wherein an eye-cup pad and a connecting member are molded integrally with each other.
Figure 27:
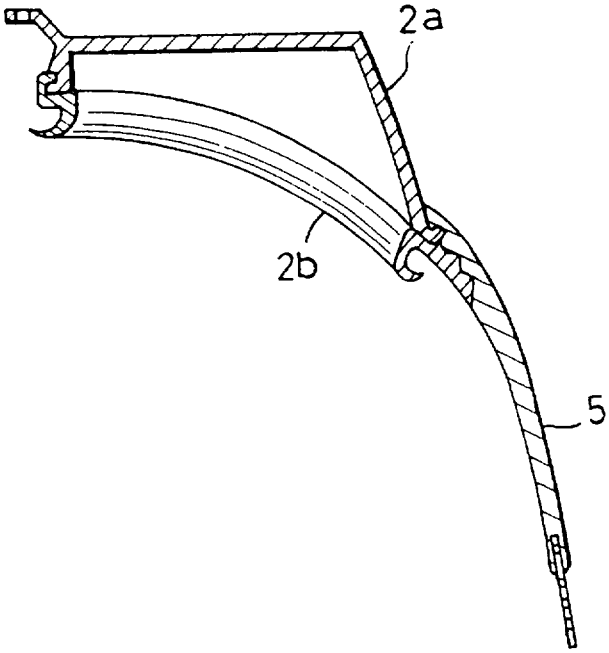
FIG. 27 is a sectional view showing an embodiment of the present invention wherein an eye-cup main body, an eye-cup pad and a connecting member are molded integrally with each other.

As shown in FIGS. 25 to 27, the eye-cup 2 may include a hard plastic made main body 2*a* and an elastic member made pad 2*b* fitted or bonded on the main body 2*a* so as to be abutted on the user's face. Thus, the connecting member 5 may be molded integrally with the main body 2*a* or the pad 2*b;* or with the main body 2*a* and the pad 2*b*.

In addition, the present invention is not limited to the above embodiment. For example, the locking shaft portion 40 may be replaced with a shaft (or pin) with a circular shape in section, and also the belt adjuster 24 and the eye-cup 2 may be relatively rotated around the shaft portion 40. Further, a correctional lens provided on the lens portion 6 of the eye-cup 2 may be adopted. Further, the present invention may be applied to goggles other than the swimming goggle, and may be suitably changed in design.

The present invention may be carried out in other forms without departing from the spirit and the essential characteristics of the present invention. The preferred embodiments described in the specification are illustrative and not restrictive. The scope of the present invention is defined by the appended claims, and all changes that fall within the meaning of the claims are intended to be embraced by the present invention.

What we claim is:

1. A swimming goggle which comprises:

a pair of right and left eye-cups;

a coupling member coupling opposed inner end portions of said pair of eye-cups with each other;

connecting member connected to outer end portions of said pair of eye-cups; and an elastic band joining the outer end portions of said connecting members with each other so as to form said swimming goggle;

wherein each of said connecting members has a length such that a rear end portion thereof reaches the vicinity of each ear when said swimming goggle is attached around the head of a person wearing the swimming goggles;

wherein at least part of said connecting members is formed in the length direction thereof from a material of rubber-like elasticity; and said part of said connecting members formed from a material of rubber-like elasticity which differs from that of said elastic band.

2. A swimming goggle according to claim 1, wherein said connecting members are respectively connected to upper and lower edge portions and front surface of said eye-cup.

3. A swimming goggle according to claim 1, wherein each of said connecting members includes a belt adjuster respectively rotatably mounted to each of said eye-cups, a tail lock mounted at the end of said elastic band, and a belt clip connecting said belt adjuster to said tail lock; and said belt clip is formed from said material of rubber-like elasticity, and said adjuster and said lock are formed of plastic.

4. A swimming goggle according to claim 3, wherein said belt adjuster is mounted to said eye-cup in such a manner as to be rotatable in the vertical direction.

5. A swimming goggle according to claim 3, wherein said belt adjuster is mounted to said eye-cup in such a manner as to be rotatable in the lateral direction.

6. A swimming goggle according to claim 3, wherein each of said connecting member is formed by integrally molding said belt adjuster, said belt clip and said tail lock.

7. A swimming goggle according to claim 4, wherein said eye-cup has a recessed portion formed at the outer end portion thereof in such a manner as to have a hollowed out portion from the outer surface side; said recessed portion is surrounded by the upper and lower walls, the outer end wall and the bottom wall; and said outer wall is formed in a circular-arc surface and which is formed with a hole communicating the interior of said recessed portion to the outside;

said belt adjuster of said connecting member has an engaging portion which is inserted in said hole with vertical play and projects within said recessed portion; said engaging portion is provided with an engaging hole; and said belt adjuster is formed with a circular-arc surface slidably contacted with said circular-arc surface of said outer end wall;

a belt stopper is fitted in an opening portion of said recessed portion; and a locking shaft portion inserted in said engaging hole is projectingly provided on said stopper; and said circular-arc surface of said outer end wall and said circular-arc surface of said belt adjuster include surfaces with circular-arcs around said locking shaft portion.

8. A swimming goggle according to claim 1, wherein said connecting member is integrally molded to said eye-cup.

9. A swimming goggle according to claim 1, wherein said eye-cup includes a hard plastic main body, and an elastic pad which is connected to said main body so as to abut the user's face; and said connecting member is integrally molded to at least said pad.

10. A swimming goggle according to claim 1, wherein said at least part of said connecting member of said swimming goggle in a length direction is formed from a non-extensible and flexible material.

11. A swimming goggle according to claim 1, wherein said connecting member comprises a hard material which is turnably joined to said eye-cup.

12. A swimming goggle according to claim 1, wherein the length of said eye-cup extending from the outer end of the lens surface of said eye-cup to the outer end of said connecting member is in the range of from about 70 mm to 100 mm.

13. A swimming goggle according to claim 1, wherein a mounting portion for mounting said coupling member is formed at each of the opposed inner end portions of said pair of eye-cups, and has upper and lower walls which are spaced closer together upon nearing an inner side of each of said eye-cups in proximity with said coupling member and wherein a flat surface is formed between said upper and lower walls and a locking hole is formed on said flat surface;

said coupling member includes a nose belt and a clip;

both end portions of said nose belt are placed on said flat surface, and are formed with holes corresponding to said locking holes; and said clip includes a fitting portion formed on a tapered surface fitted between said upper and lower walls, and leg portions project from said fitting portion and are inserted in said locking holes of said flat surface and said holes of said nose belt.

14. A swimming goggle comprising:

a pair of right and left eye-cups; and a coupling member coupling opposed inner end portions of a pair of said eye-cups;

connecting members connected to outer end portions of said eye-cups;

an elastic band joining the outer end portions of said connecting members with each other;

wherein a mounting portion mounting said coupling member is formed at each of the opposed inner end portions of said pair of said eye-cups, and which has upper and lower walls which are spaced closer together upon nearing an inner side of each of said eye-cups in proximity with said coupling member and wherein a flat surface is formed between said upper and lower walls and a locking hole is formed on said flat surface;

said coupling member includes a nose belt and a clip;

both end portions of said nose belt are placed on said flat surface, and are formed with holes corresponding to said locking holes; and said clip includes a fitting portion fitted between said upper and lower walls, and leg portions projecting from said fitting portion are inserted in said locking holes of said flat surface and said holes of said nose belt.

* * * * *